United States Patent [19]

Altland

[11] Patent Number: 4,479,594

[45] Date of Patent: Oct. 30, 1984

[54] POURING NOZZLE AND INTERMEDIATE CONTAINER OF STRANG CASTING DEVICE

[76] Inventor: Guenter Altland, Amselweg 3, 5750 Menden 2, Fed. Rep. of Germany

[21] Appl. No.: 427,271

[22] Filed: Sep. 29, 1982

[30] Foreign Application Priority Data

Dec. 24, 1981 [DE] Fed. Rep. of Germany ..... 3151533

[51] Int. Cl.[3] ..... B22D 41/08

[52] U.S. Cl. ..... 222/597; 164/437

[58] Field of Search ..... 164/337, 437; 222/590, 222/591, 593, 594, 597

[56] References Cited

U.S. PATENT DOCUMENTS 3,608,621 9/1971 Bollig et al. ..... 164/337

4,368,834 1/1983 Daussan et al. ..... 222/593

FOREIGN PATENT DOCUMENTS 2091399 7/1982 United Kingdom ..... 222/593

*Primary Examiner*—Kuang Y. Lin

*Assistant Examiner*—Richard K. Seidel

*Attorney, Agent, or Firm*—Michael J. Striker

[57] ABSTRACT

A pouring nozzle for an intermediate container of a strang casting device has a body part of a refractory material arranged in an opening of a bottom of the intermediate container, an elongated piece of refractory material associated with the body part and extending in the interior of the intermediate container, and a breakage point provided between the body part and the elongated piece at a height of the bottom of the intermediate container.

6 Claims, 3 Drawing Figures

POURING NOZZLE AND INTERMEDIATE CONTAINER OF STRANG CASTING DEVICE

BACKGROUND OF THE INVENTION

The present invention relates to a pouring nozzle for a strang casting device and to an intermediate container provided therewith.

Strang casting device are known in the art in which an intermediate container or a distributor has a pouring opening provided with a pouring sleeve of refractory material.

In the known intermediate containers, which sometimes are controlled by a slider, in the event of the open slider there are always casting difficulties, inasmuch as during the beginning of casting the melt flowing from the laddle into the intermediate container has a tendency to freeze and block the same because of the initial high temperature losses and impurities located in the intermediate container from the heating period. These casting problems cannot be eliminated even in the event that the pouring sleeve extend somewhat over the bottom of the intermediate container or the outlet, for example during open casting, is closed by a lead plug.

SUMMARY OF THE INVENTION

Accordingly, it is an object of the present invention to provide a pouring nozzle and an intermediate container therewith, which avoid the disadvantages of the prior art.

More particularly, it is an object of the present invention to provide a pouring nozzle and an intermediate container therewith which guarantee a disturbance-free casting in a casting device.

In keeping with these objects and with others which will become apparent hereinafter, one feature of the present invention resides, briefly stated, in a pouring nozzle or an intermediate container, in which a pouring nozzle has a body part of refractory material and an elongated piece also of refractory material associated with the body part, and means forming a breakage point between the body part and the elongated piece is provided at a height of a bottom of the intermediate container.

When the pouring device and the intermediate container are designed in accordance with the present invention, after reaching the desired bath level the body part is separated from the elongated piece and thereby the opening in the bottom of the intermediate container is released, so that the melt because of only small heat losses can be discharged unobjectionably and continuously, free from slag portions or other impurities. The separated elongated piece floats on the melt and cannot obstruct the free running of the melt or affect its chemical composition.

In accordance with another advantageous feature of the present invention, the body part and the elongated piece may be formed as a one-piece member provided with the breakage point. The thus elongated pouring nozzle can be broken by an iron rod or a coiled board pipe of a sufficient length through a plug cover hole or through an opening in a lateral wall of the intermediate container by a slide pipe.

The breakage point in this one-piece member can be formed as a ring-shaped groove which reduces the thickness of a wall of this one-piece member.

In accordance with a further advantageous feature of the present invention, the body part of the pouring nozzle and the elongated piece are formed as two members, and the breakage point is formed as a refractory binding medium between these two members.

The refractory binding the medium is selected so that its heat strength lies in the region of the liquefying temperature of a melt to be cast. Upon reaching the predetermined temperature, the elongated piece releases automatically from the body part of the pouring nozzle and rises in the melt.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
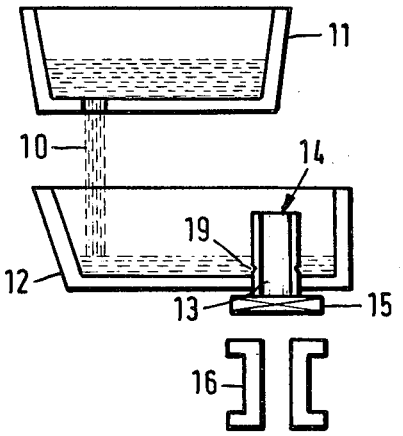
FIG. 1 is a view showing a part of a strang testing device with an intermediate container and a pouring nozzle in accordance with the present invention.

FIG. 1 shows a portion of a continuous casting device of conventional construction. A liquid raw steel 10 flows from a casting ladle 11 to an intermediate container or distributor 12. From the intermediate container 12, the raw steel flows to a copper mold (ingot mold). More particularly, the raw steel flows from the intermediate container 12 to the mold 16 through an outlet opening 13 which is closable by an elongated pouring sleeve 14, and through an opened slider or gate 15 formed, for example, as a three-plate regulating gate.

The copper mold 16 is arranged exactly vertically and opened at both its sides. During casting it is closed only at its opposite side. The melt cools in the mold 16 exactly for so long that is can form a bearing outer shell. The partially rigidified strang is removed from the form vertically, horizontally or in a curved path, in dependence upon the design of the casting device.

Figure 2:
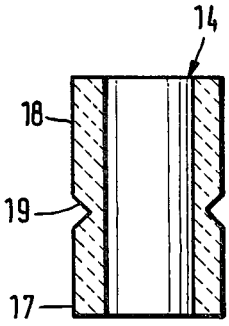
FIG. 2 is a view showing a pouring nozzle of FIG. 1 on an enlarged scale.

The elongated outlet sleeve 14 and also the distributor 12 are composed advantageously of strong alumina-containing refractory material. The pouring sleeve 14 is composed of a lower part 17 and an upper part or upper sleeve piece 18, as can be seen from FIG. 2. They are advantageously formed of one piece with one another. The pouring sleeve 14, at the point of transition between the parts 17 and 18, is formed with a breaking point in form of a groove-shaped breakage ring 19. The length of the lower portion 17 of the pouring sleeve 14 substantially corresponds to the known pouring sleeves whose one end in mounted condition extends advantageously by substantially 20–30 mm outwardly above the bottom of the intermediate container. The entire length of the pouring sleeve 14 which is lengthened in such a manner is adjusted advantageously in correspondence with the desired bath level height. In practice the length of the upper sleeve piece 18 is considered sufficient to be equal to approximately 200 mm.

Figure 3:
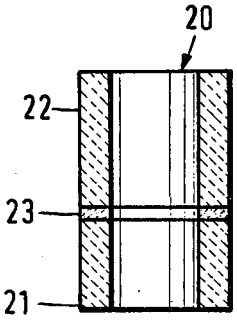
FIG. 3 is a view substantially corresponding to the view of FIG. 2, but showing a further embodiment of the pouring nozzle in accordance with the present invention.

FIG. 3 shows a further embodiment of lengthened pouring sleeve which is identified here with reference numeral 20. In contrast to the above described one-piece sleeve 14, the pouring sleeve 20 is formed of two parts. A lower part 21 and an upper part or an upper sleeve piece 22 are connected with one another in butt relationship with the aid of a refractory binding medium 23. This binding medium 23 forms a breakage point between both part and has a heat strength lying in the region of the liquefaction temperature of the melt to be cast. As a result of this, the breakage point is dissolved only when the desired bath level height is reached in the intermediate container. A high heat strength of the introduced binding medium guarantees a longer dwell time of the melt prior to casting in the intermediate container, so that undesirable metal impurities can bubble up in the slag zone.

As material for the binding medium, hot glue or other suitable carbon-containing burning-out materials can be used, which upon attaining a predetermined temperature automatically release the upper sleeve piece 22. An equally good action can also be attained with the aid of materials which because of their thermal properties expand under fire (burning-out) and thrust the upper sleeve piece.

The above mentioned invention is described exclusively in connection with a slider-controlled continuous casting device. However, it is to be understood that its features can be applied without structural changes, and without affecting the operation, also to devices which operate in open condition.

The present invention can also be used in so-called multiple-strand devices in which double or triple ingot molds are assembled in one mold block. In such devices it is possible, without danger of casting disturbances, to oscillate the molds assembled in the respective lifting tables prior to the start of casting together with one another and also to remove the strangs from the respective block together, inasmuch as the molds in the inventive device are supplied approximately with synchronization in a matter of seconds with the same quantities of metal.

The inventive features can also be used in a device of joint hybrid cast system without difficulties. Strang casting devices of conventional types can also use the inventive features regardless of the number of their strangs or strang shapes within the frame of open or slider-regulated casting methods.

It will be understood that each of the elements described above, or two or more together, may also find a useful application in other types of constructions differing from the types described above.

While the invention has been illustrated and described as embodied in a pouring nozzle for a strang casting device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An intermediate container of a strand casting device, comprising a container part having a bottom with an opening;

a pouring nozzle of a refractory material, arranged in said opening of said bottom of said container part;

an elongating piece of a refractory material, associated with said pouring nozzle and extending into the interior of said container part; and means forming a breakage point between said pouring nozzle and said elongating piece at a height of said bottom of said container part, said nozzle, said piece and said means together forming an uniterrupted integral element.

2. An intermediate container as defined in claim 7, wherein said pouring nozzle and said elongated piece are formed as a one piece member having a wall.

3. An intermediate container as defined in claim 8, wherein said wall of said one-piece member has a predetermined thickness, said breakage point forming means including a groove which reduces the thickness of said wall of said one-piece member.

4. An intermediate container as defined in claim 9, wherein said groove in said all of said one-piece member is ring-shaped.

5. An intermediate container as defined in claim 7, wherein said pouring nozzle and said elongating piece are formed as separate members, said breakage point forming means including a refractory binding medium integrally connecting said separate members with one another.

6. An intermediate container as defined in claim 11, wherein said binding medium has a thermal strength lying in the region of a liquefying temperature of a melt to be cast.

* * * * *